US007328525B2

(12) United States Patent
Lim

(10) Patent No.: US 7,328,525 B2
(45) Date of Patent: Feb. 12, 2008

(54) SHOE WITH VENTILATING OPENING

(76) Inventor: SongJo Lim, San 120-1, Sambang-dong, Kimhae, Kyungnam (KR)

( * ) Notice: Subject to any disclaimer, the term of this patent is extended or adjusted under 35 U.S.C. 154(b) by 20 days.

(21) Appl. No.: 11/245,604

(22) Filed: Oct. 7, 2005

(65) Prior Publication Data

US 2006/0032083 A1 Feb. 16, 2006

Related U.S. Application Data

(63) Continuation of application No. PCT/KR2004/000794, filed on Apr. 7, 2004.

(51) Int. Cl.
*A43B 7/06* (2006.01)

(52) U.S. Cl. ..... 36/3 B

(58) Field of Classification Search ..... 36/3 R, 36/3 A, 3 B, 29

See application file for complete search history.

(56) References Cited

U.S. PATENT DOCUMENTS

| | | | | | |
|---|---|---|---|---|---|
| 1,364,226 | A * | 1/1921 | Wherry | 36/3 R |
| 3,738,024 | A * | 6/1973 | Matsuda | 36/29 |
| 4,009,528 | A * | 3/1977 | Villari et al. | 36/29 |
| 4,100,685 | A | 7/1978 | Dassler | 36/3 |
| 4,417,407 | A | 11/1983 | Fukuoka | 36/3 |
| 4,602,441 | A * | 7/1986 | El Sakkaf | 36/3 R |
| 4,995,173 | A * | 2/1991 | Spier | 36/29 |
| 5,341,581 | A * | 8/1994 | Huang | 36/3 B |
| 5,606,806 | A * | 3/1997 | O'Dwyer | 36/3 B |
| 5,813,140 | A * | 9/1998 | Obeid | 36/3 R |
| 5,860,225 | A * | 1/1999 | O'Dwyer | 36/3 B |
| 5,975,861 | A * | 11/1999 | Shin et al. | 36/3 B |
| 2002/0194747 | A1 * | 12/2002 | Passke et al. | 36/29 |

FOREIGN PATENT DOCUMENTS

| | | | |
|---|---|---|---|
| EP | 0 792 593 | | 9/1997 |
| GB | 2245145 A | * | 1/1992 |
| JP | 9 299193 | | 11/1997 |
| WO | WO 87/03789 | * | 7/1987 |
| WO | WO 89/10073 | * | 11/1989 |

* cited by examiner

*Primary Examiner*—Ted Kavanaugh
(74) *Attorney, Agent, or Firm*—Tuchman & Park LLC

(57) ABSTRACT

The present invention relates to a shoe with a ventilating opening. The shoe includes an upper part having a through hole and an inner part with a path hole, and a shoe sole mounted to the upper part and having both an air passage and an air channel communicating with each other. An elastic unit is provided on a lower surface of the shoe sole by being projected downward while longitudinally extending to correspond to the air passage. An air circulation unit is provided at the front part of the shoe sole to be attached to a front end of the upper part, with an air circulation path provided in the air circulation unit to communicate with both an air inlet and the air channel. Thus, fresh air is introduced into the shoe.

17 Claims, 10 Drawing Sheets

SHOE WITH VENTILATING OPENING

This application is a continuation of International Patent Application No. PCT/KR2004/000794 filed on Apr. 7, 2004 which designated the United States and claims priority from Korean Patent Application Nos. 20-2003-0010489 filed on Apr. 7, 2003 and 20-2003-0019671 filed on Jun. 21, 2003.

FIELD OF THE INVENTION

The present invention relates, in general, to shoes, and more particularly, to a shoe which is provided with a ventilating opening to circulate air through the ventilating opening while a user is mobile, thus ventilating the interior of the shoe with fresh air.

BACKGROUND OF THE INVENTION

Generally, a shoe is a covering for the human foot to protect and support the foot. In other words, shoes cover and shield human feet to protect and support the feet while a user wearing the shoes walks or runs.

Most conventional shoes have been made of leather or synthetic resin material, but the materials and design of the shoes provide only poor ventilation effects to the feet. Thus, when a user continuously wears the shoes for lengthy periods, the poor ventilation effects of the shoes increase the temperatures of space in the shoes, cause the interiors of the shoes to be dampish due to the perspiration of the feet, and promote an inhabitation of fungi in the shoes, resulting in an offensive odor and Athlete's foot.

To solve the above-mentioned problems, shoes having various designs to provide ventilation effects have been developed and proposed.

Some representative examples of conventional techniques relating to shoes with the ventilation effects will be described in brief as follows.

Korean Utility Model Registration No. 20-144133 discloses an air circulation structure for shoe soles. The above-mentioned conventional technique provides a separate pump unit installed in a shoe to introduce outside air to the inside of the shoe sole. However, this technique is problematic in that the air circulation structure has a complex construction and does not allow for any smooth circulation of air, and may undesirably introduce impurities into the shoe.

Korean Utility Model Registration No. 20-218227 discloses a shoe sole with a vent hole. This technique provides a structure to circulate air to the inside of the shoe sole using an air tube. However, this technique is problematic in that the air circulation structure has a complex construction and does not allow for any smooth circulation of air, and may undesirably introduce impurities into the shoe.

Korean Utility Model Registration No. 20-229738 discloses a shoe with a ventilation unit. This technique provides both a cushion layer to function as a pump and a check valve means, thus circulating air to the lower portion of the interior of the shoe. However, the above-mentioned technique is problematic in that it provides only a complex construction without allowing for any smooth circulation of air, and cannot prevent the introduction of impurities into the shoe.

DISCLOSURE OF THE INVENTION

Accordingly, the present invention has been made keeping in mind the above problems occurring in the prior art, and an object of the present invention is to provide a shoe which is provided with a ventilating opening at a front part of the shoe so that the ventilating opening communicates with the interior of the shoe, thus allowing for a smooth circulation of air into or from the interior of the shoe while a user wearing the shoes is mobile.

Another object of the present invention is to provide a shoe of which the ventilating opening that communicates with the interior of the shoe is opened or closed as desired.

In order to accomplish the above objects, the present invention provides a shoe with a ventilating opening, comprising: an upper part provided at a lower end thereof with an inner part having a vertical path hole, with a through hole provided on a front part of the upper part; a shoe sole mounted to a lower portion of the upper part, with an air passage provided by being depressed downward on an upper surface of the shoe sole and extending from a front part to a rear part of the shoe sole, and an air channel provided in the front part of the shoe sole to communicate with the air passage; an elastic unit provided by projecting downward on a lower surface of the shoe sole while extending from the front part to the rear part of the shoe sole, thus corresponding to the air passage; and an air circulation unit provided at the front part of the shoe sole and attached to a front end of the upper part, with an air circulation path provided in the air circulation unit to communicate with both an air inlet through which air passes and the air channel, and an entrance provided on a rear part of the air circulation unit to communicate with both the air circulation path and the through hole of the upper part.

In the present invention, the air circulation unit may be provided on an end thereof with an ON/OFF control unit to selectively open or close the air inlet. The ON/OFF control unit may comprise: a connection bracket mounted to the air circulation unit; a body having a plate shape and mounted to the connection bracket; a grip provided on an end of the body; an ON/OFF control plug projecting outward from a front part of the body to be inserted into the air inlet of the air circulation unit; and a locking protrusion projecting outward from a rear part of the body to engage with a locking slot that is provided on an end of the air circulation unit.

Furthermore, the shoe sole may be provided with an elastic groove which is formed by being depressed upward on the lower surface of the shoe sole along each of both side edges of the elastic unit.

Furthermore, an air chamber may be provided in the shoe sole at a position to correspond to the elastic unit so that the air chamber communicates with the air passage and stores air therein, wherein both the air passage and the air chamber are sealed on tops thereof, with a first check valve provided in the air channel that communicates with the air passage, a vent hole provided on an upper surface of the air passage to communicate with an interior of the upper part, and a second check valve provided in the vent hole. The air chamber may be provided on a lower portion thereof with a reinforcing member. The air passage and the air chamber may comprise at least two air passages and at least two air chambers, respectively. The shoe sole may comprise a lower sole part, a middle sole part and an upper sole part.

Thus, in the shoe according to the present invention, fresh air is continuously introduced into the interior of the shoe to absorb heat, and thereby reduce the temperature of space in the shoe, and to prevent the interior of the shoe from being dampish due to the perspiration of the foot.

Figure 1:
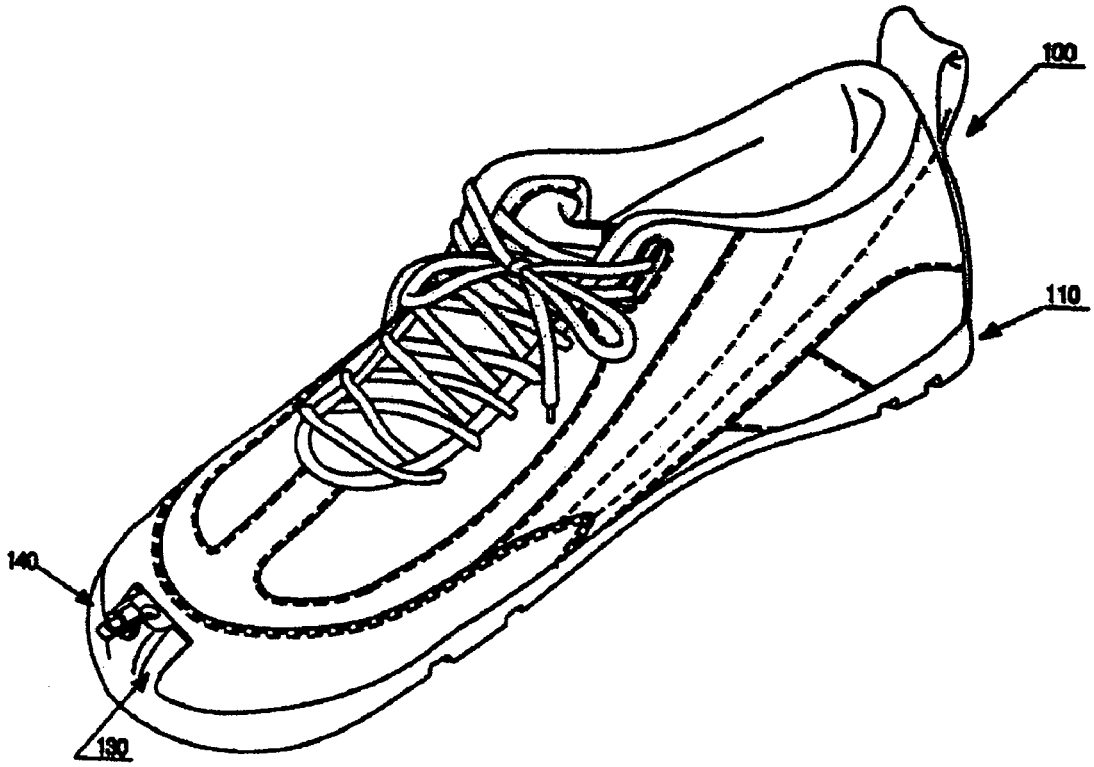
FIG. 1 is a perspective view of a shoe with a ventilating opening according to the present invention.

<Description of the important elements in the drawings>

| | | | |
|---|---|---|---|
| 100: | upper part | 101: | inner part |
| 102: | path hole | 103: | through hole |
| 110: | shoe sole | 111: | air passage |
| 112: | air channel | 113: | lower sole part |
| 113a: | depression | 114: | middle sole part |
| 114a: | front slot | 114b: | rear slot |
| 114c: | opening | 115: | upper sole part |
| 120: | elastic unit | 121: | elastic groove |
| 130: | air circulation unit | 133: | air inlet |
| 131: | air circulation path | 136: | locking slot |
| 132: | body | 142: | body |
| 135: | entrance | 144: | ON/OFF control plug |
| 140: | ON/OFF control unit | 150: | air chamber |
| 141: | connection bracket | 161: | valve seat |
| 143: | grip | 170: | second check valve |
| 145: | locking protrusion | 172: | valve body |
| 160: | first check valve | 180: | reinforcing member |
| 162: | valve body | | |
| 171: | valve seat | | |
| 173: | vent hole | | |

DETAILED DESCRIPTION OF PREFERRED EMBODIMENTS

Herein below, the preferred embodiments of the present invention will be described in detail with reference to the accompanying drawings.

First Embodiment

Figure 2:
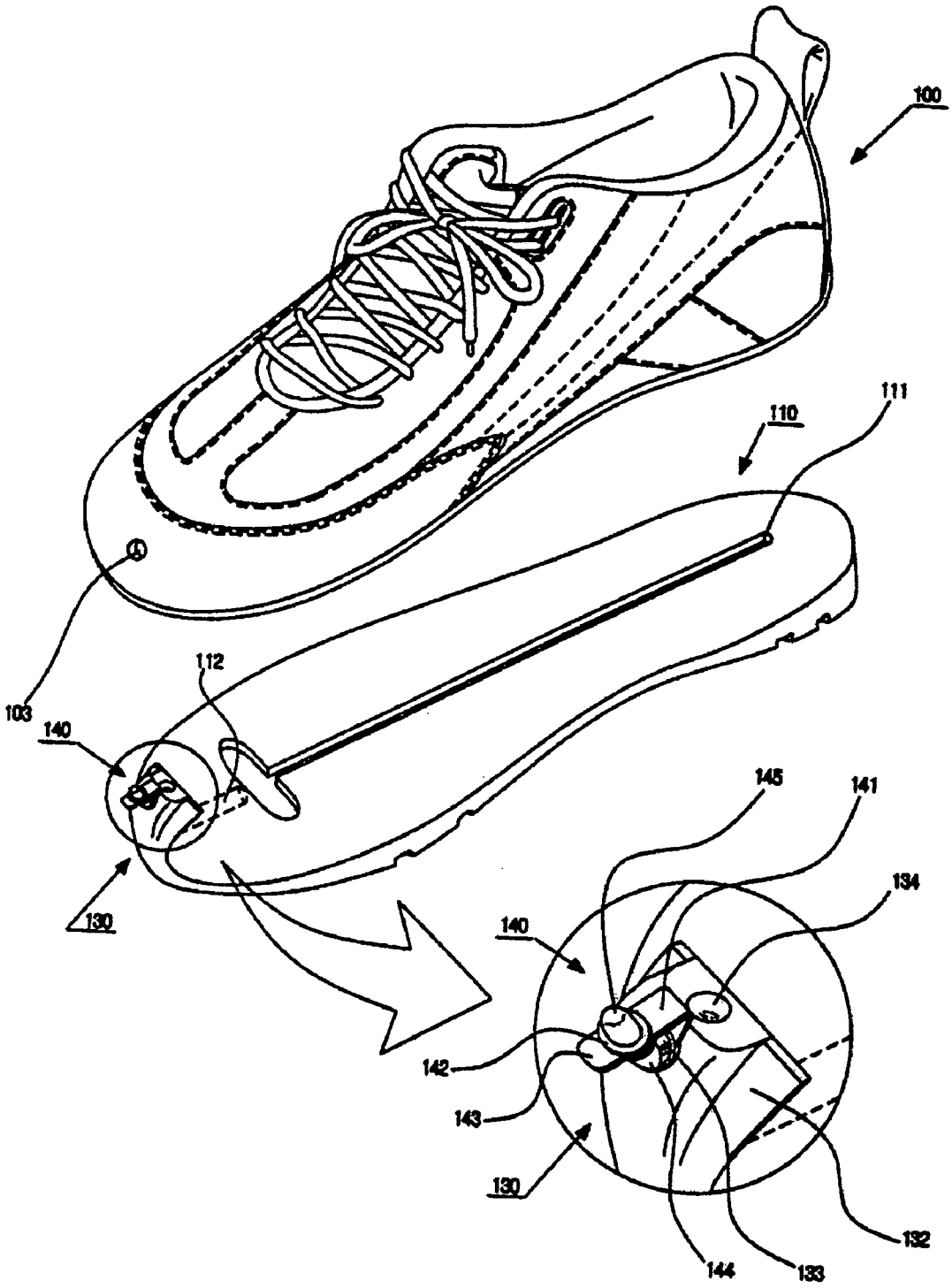
FIG. 2 is an exploded perspective view of a shoe according to a first embodiment of the present invention.
Figure 3:
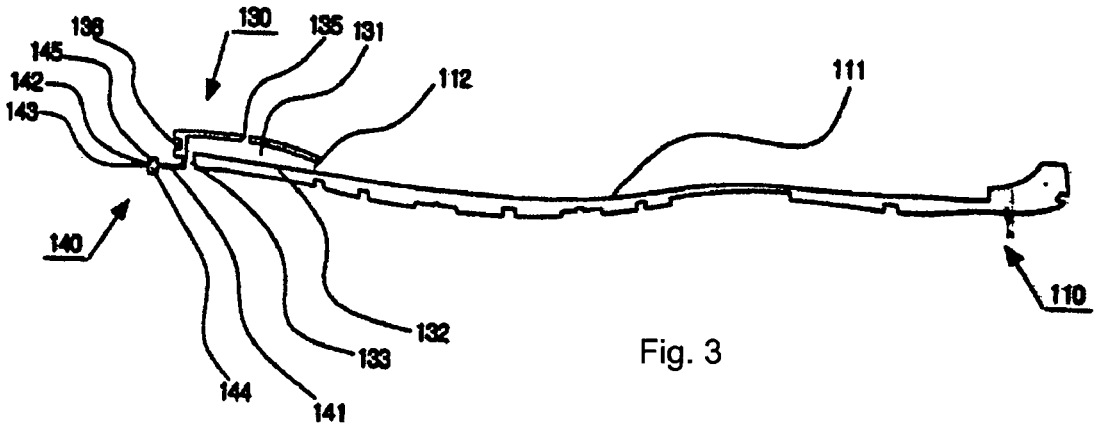
FIG. 3 is a longitudinal sectioned view showing specific parts of a shoe sole provided with an air circulation unit according to the first embodiment of the present invention.
Figure 4:
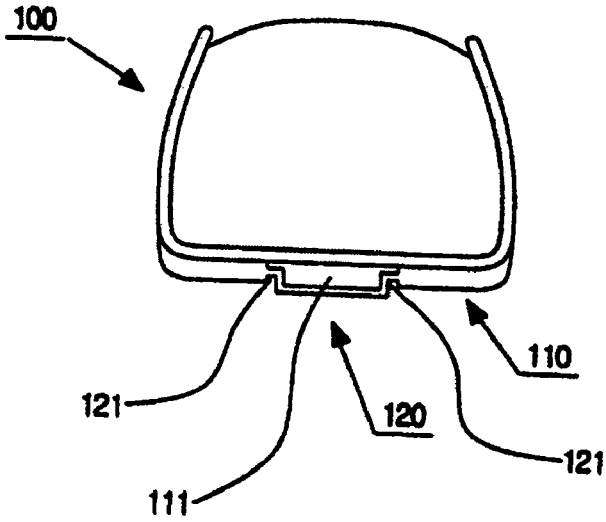
FIG. 4 is a latitudinal sectioned view showing specific parts of the shoe sole provided with the air circulation unit according to the first embodiment of the present invention.
Figure 5:
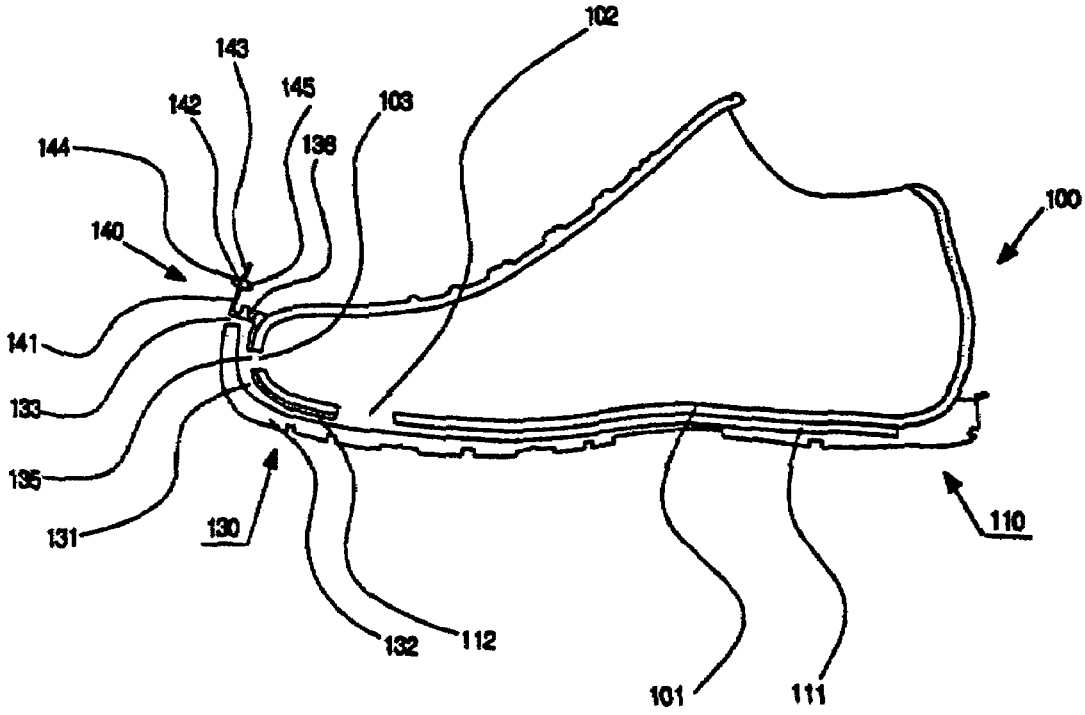
FIG. 5 is a longitudinal sectioned view showing specific parts of the shoe according to the first embodiment of the present invention.

FIG. 1 is a perspective view of a shoe with a ventilating opening according to the present invention. FIG. 2 is an exploded perspective view of a shoe according to the first embodiment of the present invention. FIG. 3 is a longitudinal sectioned view showing specific parts of a shoe sole provided with an air circulation unit according to the first embodiment of the present invention. FIG. 4 is a latitudinal sectioned view showing specific parts of the shoe sole provided with the air circulation unit according to the first embodiment of the present invention. FIG. 5 is a longitudinal sectioned view showing specific parts of the shoe according to the first embodiment of the present invention.

As shown in the drawings, the shoe according to the present invention comprises an upper part 100, a shoe sole 110, an elastic unit 120, an air circulation unit 130, and an ON/OFF control unit 140.

The upper part 100 will be first described herein below.

The upper part 100 defines the appearance of the shoe, with an inner part 101 integrated with a lower end of the upper part 100. The inner part 101 is provided with a path hole 102 which is vertically formed through the inner part 101, so that air from an air passage 111 of the shoe sole 110 which will be described in detail herein flows vertically through the path hole 102.

Furthermore, a through hole 103 is formed at a toe portion of the front part of the upper part 100 so that the through hole 103 communicates with an entrance 135 of the air circulation unit 130 when the air circulation unit 130 which will be described in detail herein is mounted to the front part of the upper part 100.

The shoe sole 100 is made of a rubber material and is mounted to the lower portion of the upper part 100.

The shoe sole 110 has the air passage 111 that is formed by being depressed downward on an upper surface of the shoe sole 110 so that the air passage 111 having a predetermined width extends from a front part to a rear part of the shoe sole 110.

Furthermore, an air channel 112 having a tubular shape longitudinally extends in the front part of the shoe sole 110 at a position in front of the air passage 111 to communicate with the air passage 111 and to reach the front end of the shoe sole 111.

The above-mentioned air channel 112 communicates with an air circulation path 131 of the air circulation unit 130 which will be described in detail herein, thus defining an air path through which air passes.

The elastic unit 120 is provided on a lower surface of the shoe sole 110 to correspond to the air passage 111 of the shoe sole 110. In other words, to correspond to the air passage 111 of the shoe sole 110, the elastic unit 120 longitudinally extends on the lower surface of the shoe sole 110 from the front part to the rear part of the shoe sole while projecting downward from the lower surface of the shoe sole 110.

In the above case, the elastic unit 120 preferably projects from the lower surface of the shoe sole 110 to a height of about 3~4 mm from a remaining part of the lower surface of the shoe sole 110.

Furthermore, an elastic groove 121 to allow for an elastic deformation of the elastic unit 120 is formed by being depressed upward on the lower surface of the shoe sole along each of both side edges of the elastic unit 120.

Thus, when the shoe worn by a user comes into contact with the ground, the elastic unit 120 is compressed upward and elastically deformed by a contact pressure applied thereto from the ground, thus being horizontally leveled with the remaining part of the lower surface of the shoe sole 110. Due to the above-mentioned upward compressed state of the elastic unit 120, the air passage 111 provided on the upper surface of the shoe sole 110 is reduced in the sectional area. Thus, the air in the air passage 111 forcibly circulates in the passage 111 and is discharged to the outside of the shoe. When the contact pressure is removed from the shoe by a separation of the shoe from the ground, the elastic unit 120 elastically restores an original shape thereof. Thus, the compressed air passage 111 elastically restores an original sectional area thereof, so that fresh air is introduced from the atmosphere into the air passage 111. In other words, the elastic unit 120 functions as a semi-permanent air pump as well as serves like an air bag to absorb any impact.

The air circulation unit 130 is assembled with the front part of the shoe sole 110 so that the air circulation unit 130 is exposed to the outside of the front of the shoe. In the above state, the inner surface of the air circulation unit 130 faces the front end of the upper part 100.

In the present invention, the air circulation unit 130 may be produced as an integrated structure with the shoe sole 110. However, it should be understood that the air circulation unit 130 may be separately produced from the shoe sole 110 prior to being assembled with the front part of the shoe sole 110, particularly, in the case of shoes for men or women, etc.

The air circulation unit 130 comprises a body 132, an air inlet 133, the air circulation path 131, a locking slot 134, and the entrance 135.

The body 132 is constructed to have a predetermined thickness and width, with the air circulation path 131 having a tubular shape and provided in the body 132. One end of the air circulation path 131 communicates with the air inlet 133 that is provided on a front surface of the body 132 which is placed around the front end of the shoe. In the meantime, the other end of the air circulation path 131 communicates with the air channel 112 of the shoe sole 110.

Furthermore, the entrance 135 is provided on a rear part of the body 132 to communicate with the air circulation path 131. The entrance 135 communicates with the through hole 103 of the upper part 100 when the air circulation unit 130 is mounted to the front part of the upper part 100.

Thus, a first air path, through which a part of inlet air that has passed through the air inlet 133 flows to the interior of the shoe, is orderly defined by the air circulation path 131, the entrance 135, and the through hole 103 of the upper part 100. Furthermore, a second air path, through which the remaining volume of the inlet air that has passed through the air inlet 133 flows to the interior of the shoe, is orderly defined by the air circulation path 131, the air channel 112 and the air passage 111 of the shoe sole 110, and the path hole 102 of the inner part 101.

The body 132 of the air circulation unit 130 is provided on a front end thereof with a locking slot 136. The locking slot 136 is assembled with a locking protrusion 145 of the ON/OFF control unit 140 which will be described in detail herein. To provide the locking slot 136, the front end of the body 132 is depressed inward.

The ON/OFF control unit 140 is made of a rubber or a synthetic resin material, and comprises a connection bracket 141, a body 142, a grip 143, an ON/OFF control plug 144 and a locking protrusion 145.

The connection bracket 141 has a band shape with a predetermined width, and is mounted at an end thereof to the front end of the air circulation unit 130. The body 142 having a plate shape is provided on the other end of the connection bracket 141, while the grip 143 having a predetermined width is provided on an end of the body 142.

The ON/OFF control plug 144 projects outward from a side surface of the body 142. When the ON/OFF control plug 144 is inserted into the air inlet 133 of the air circulation unit 130, the air path between the interior of the shoe and the atmosphere is closed.

The locking protrusion 145 having the same shape as that of the ON/OFF control plug 144 projects outward from the other side surface of the body 142. The locking protrusion 145 is inserted into the locking slot 136 of the air circulation unit 130, so that the ON/OFF control unit 140 is prevented from being undesirably moved.

In the case of outdoor shoes, it is preferred to provide the ON/OFF control unit 140 in the shoe, because the air inlet 133 of the outdoor shoe must be closed by the control unit 140 on a rainy or cold day to prevent water or cold air from being introduced into the shoe through the air inlet 133. However, in the case of indoor shoes, the ON/OFF control unit 140 may not be provided in the shoe because the indoor shoes are typically used indoor.

The operational effect of the shoe having the above-mentioned construction will be described herein below.

Prior to walking or running, a user wearing the shoes removes the ON/OFF control plug 144 of the ON/OFF control unit 140 from the air inlet 133 of the air circulation unit 130 of each shoe. While walking or running, the user separates a foot from the ground to take a step forward while the other foot is in contact with the ground.

When the user separates a foot from the ground to take a step forward, outside air is introduced into the air circulation path 131 of the air circulation unit 130 through the air inlet 133 provided on the front part of the shoe.

In the above state, a part of the inlet air flows to the interior of the shoe orderly through the entrance 135 of the air circulation unit 130 and the through hole 103 of the upper part 100. At the same time, a remaining volume of the inlet air flows to the air passage 111 through the air channel 112 of the shoe sole 110, and thereafter, flows to the interior of the shoe through the path hole 102 of the inner part 101.

Because the outside air is introduced into the interior of the shoe as described above, the interior of the shoe is ventilated.

When the shoe worn by the user comes into contact with the ground, the elastic unit 120 of the shoe sole 110 is compressed upward and elastically deformed by a contact pressure applied thereto from the ground, thus being horizontally leveled with the remaining part of the lower surface of the shoe sole 110. Due to the above-mentioned upward compressed state of the elastic unit 120, the air passage 111 provided on the upper surface of the shoe sole 110 is reduced in the sectional area. Thus, a part of the air having been stored in the air passage 111 forcibly flows to the air circulation path 131 of the air circulation unit 130 through the air channel 112 prior to being discharged to the atmosphere through the air inlet 133.

A remaining volume of the air having been stored in the air passage 111 forcibly flows to the interior of the shoe through the path hole 102 of the inner part 101. In the shoe, the air is mixed with the existing warm air prior to flowing to the air circulation path 131 of the air circulation unit 130 orderly through the through hole 103 of the upper part 100 and the entrance 135 of the air circulation unit 130. Thereafter, the air is discharged to the atmosphere through the air inlet 133.

As described above, air smoothly flows into and from the interior of the shoe while a user is mobile, the interior of the shoe is kept in a dry state and repeatedly ventilated with fresh air.

When using the shoes on a rainy or cold day, the user closes the air inlets 133 of his/her shoes by the ON/OFF control units 140 to prevent water or cold atmospheric air from being introduced into the shoes.

Second Embodiment

Figure 6:
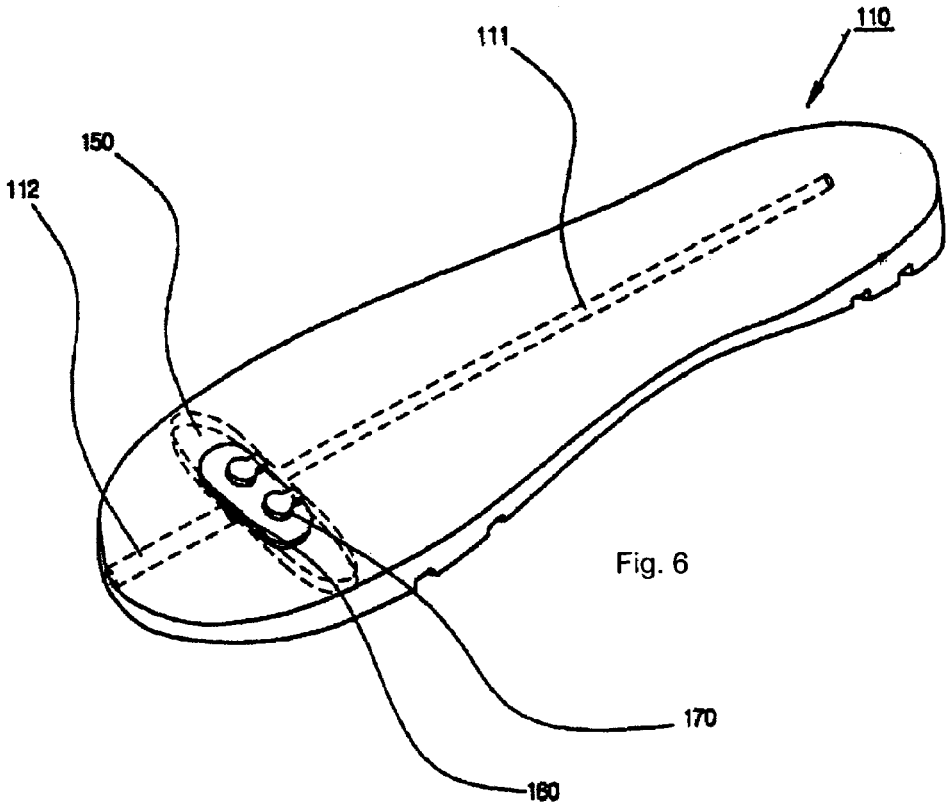
FIG. 6 is a perspective view of a shoe sole according to a second embodiment of the present invention.
Figure 7:
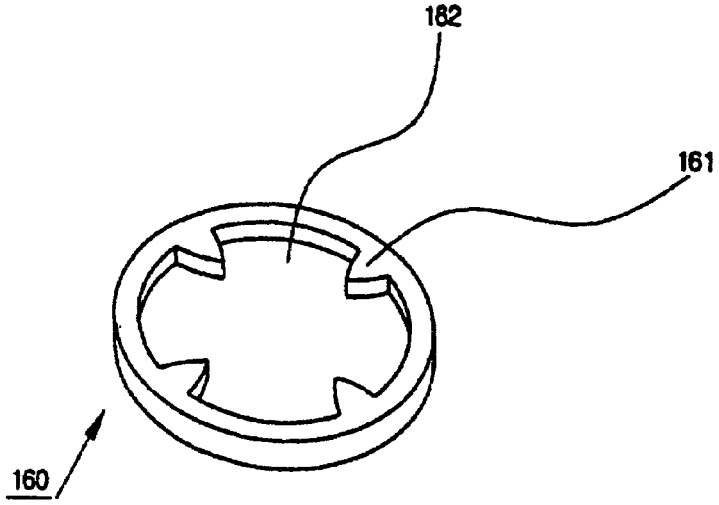
FIG. 7 is a view showing a first check valve provided in the shoe sole of FIG. 6.
Figure 8:
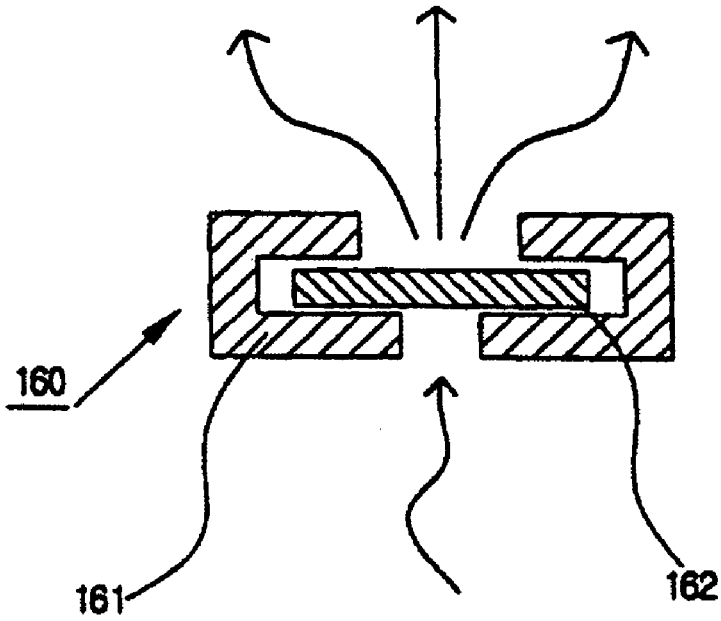
FIG. 8 is a sectional view showing specific parts of FIG. 7.
Figure 9:
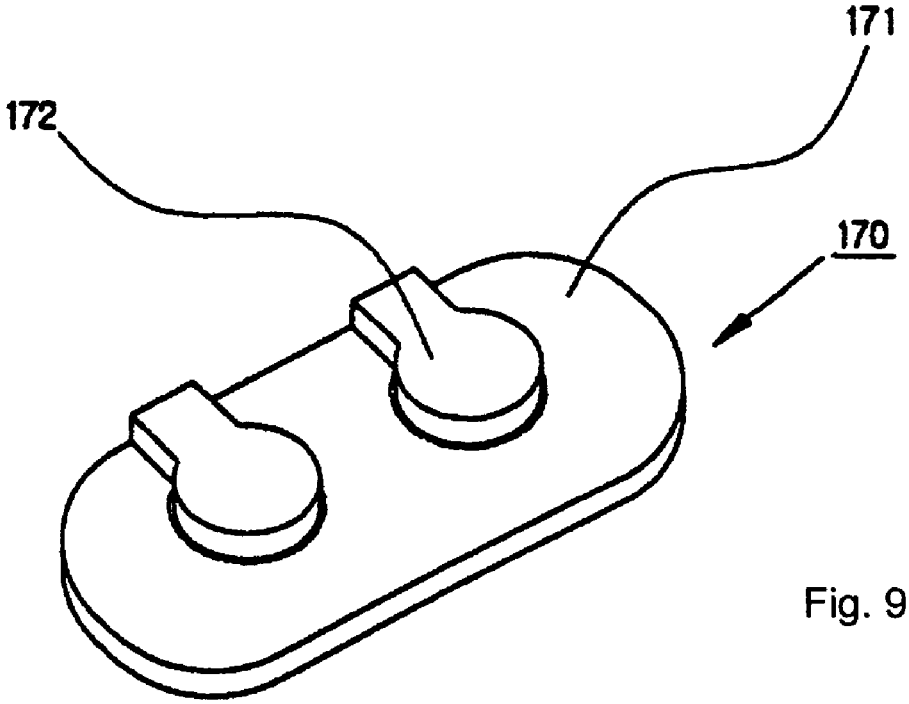
FIG. 9 is a view showing a second check valve provided in the shoe sole of FIG. 6.
Figure 10:
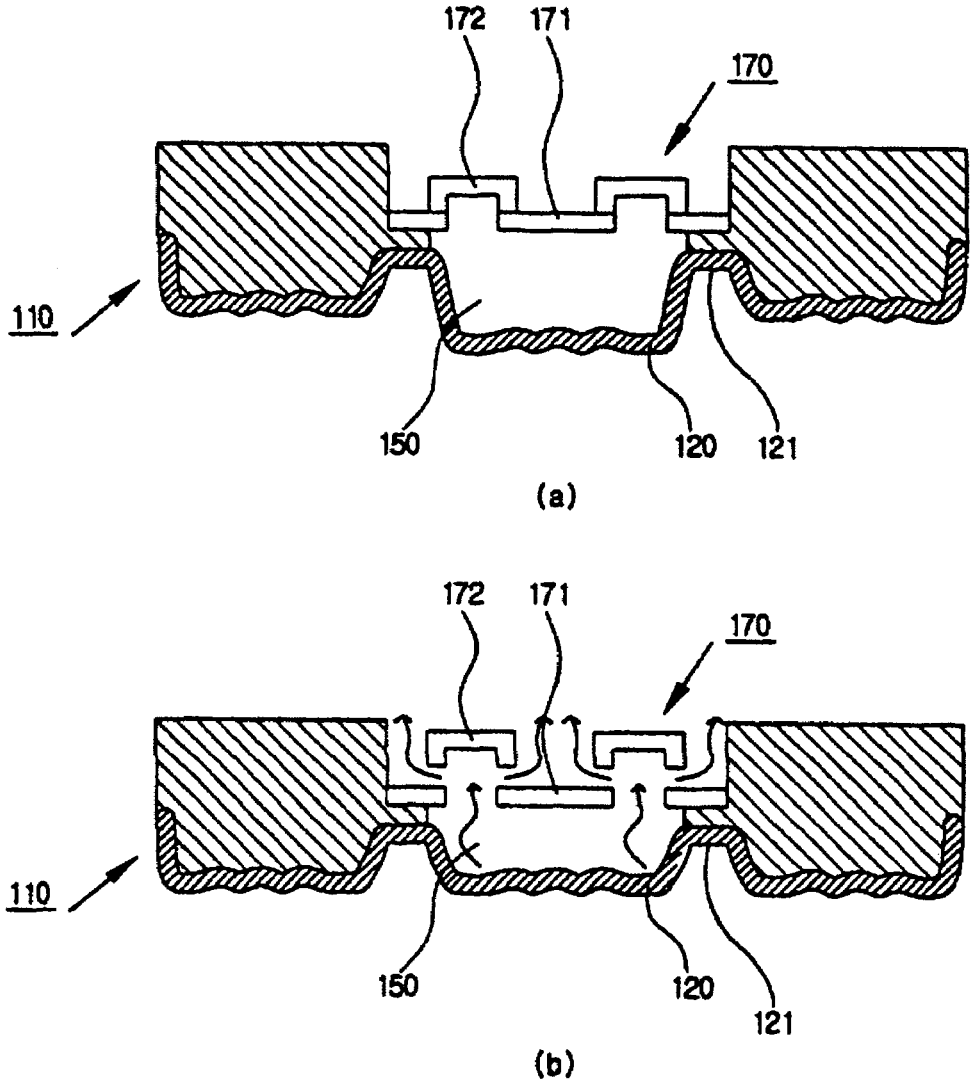
FIG. 10 is longitudinal sectioned views showing states of specific parts of the second check valve, in which: (a) shows a state before the second check valve is opened, and (b) shows a state after the second check valve is opened.

FIG. 6 is a perspective view of a shoe sole according to the second embodiment of the present invention. FIG. 7 is a view showing a first check valve provided in the shoe sole of FIG. 6. FIG. 8 is a sectional view showing specific parts of FIG. 7. FIG. 9 is a view showing a second check valve provided in the shoe sole of FIG. 6. FIG. 10 is longitudinal sectioned views showing states of specific parts of the second check valve, in which: (a) shows a state before the second check valve is opened, and (b) shows a state after the second check valve is opened.

As shown in the drawings, the general shape of the shoe according to the second embodiment remains the same as that described for the first embodiment, except for a provision of an air chamber 150 which is provided between the air passage 111 and the air channel 112 of the shoe sole 110 to communicate with both the air passage 111 and the air channel 112, and a sealed structure in which both the air passage 111 and the air chamber 150 are covered on tops thereof with the same material as that of the shoe sole 110, thus being sealed from the outside.

Furthermore, a first check valve 160 is provided in the air channel 112, while a second check valve 170 is provided on an upper surface of the air chamber 150 to communicate with the air chamber 150 and selectively allow air to flow upward from the interior of the air chamber 150.

The first check valve 160, which comprises a valve seat 161 and a valve body 162, is installed in the air channel 112 to allow for a normal flowing of air from the air channel 112 to the air chamber 150 but prevent a reverse flowing of air from the air chamber 150 to the air channel 112.

The second check valve 170, which comprises a valve seat 171 and a valve body 172, is installed on the upper surface of the air chamber 150 to communicate with the air chamber 150. Thus, the valve body 172 is opened by the inner pressure of the air chamber 150 to allow air to flow upward from the air chamber 150 to a space above the shoe sole 110 through the opened valve body 172.

In the present invention, the valve seat 161 of the first check valve is preferably produced through a plastic injection molding process, while the valve body 162 is preferably made of a synthetic resin sheet.

In the meantime, the valve seat 171 of the second check valve 170 is preferably made of a rubber material, while the valve body 172 is preferably made of the same rubber material by projecting the valve body 172 upward from the upper surface of the valve seat 171 to a predetermined height. A cut line is formed around a cylindrical body of the valve body 172.

When the shoe, according to the second embodiment, comes into contact with the ground, the elastic unit 120 of the shoe sole 110 is compressed upward and elastically deformed by a contact pressure applied thereto from the ground, thus being horizontally leveled with the remaining part of the lower surface of the shoe sole 110. Due to the above-mentioned upward compressed state of the elastic unit 120, both the air passage 111 and the air chamber 150 provided on the upper surface of the shoe sole 110 are reduced in the sectional areas. Thus, the first check valve 160 prevents the air that has stored in the air chamber 150 from flowing to the air channel 112, while the second check valve 170 allows the air to flow to the space above the shoe sole 110. Thus, fresh air is introduced to the interior of the shoe.

When the shoe is separated from the ground, the elastic unit 120 expands to open the first check valve 160 and close the second check valve 170 by an expansion pressure of the elastic unit 120. Thus, fresh outside air is introduced into the air chamber 150 through the first check valve 160 and the air channel 112.

Figure 11:
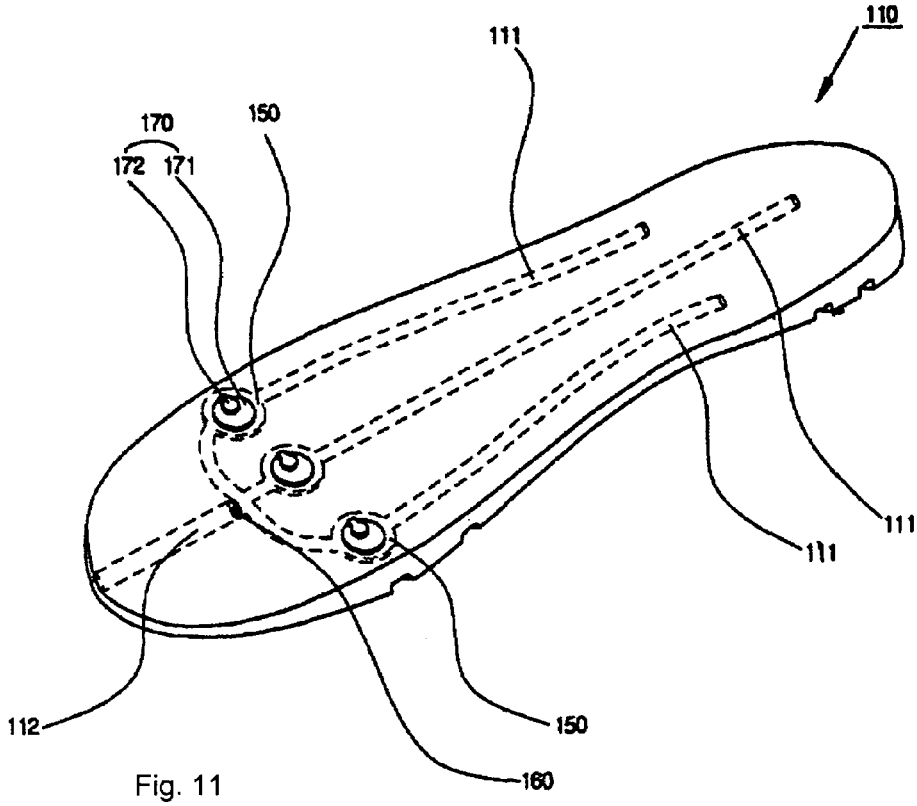
FIG. 11 is a perspective view showing a shoe sole provided with a plurality of air passages according to the present invention.

In the present invention, the second check valve 170 may comprise two or more check valves as shown in FIG. 11.

In other words, a plurality of air chambers 150 and a plurality of air passages 111 may be provided on the shoe sole 110 to communicate with the air channel 112. In the above state, a second check valve 170 is provided in each of the plurality of air chambers 150, so that the air which has stored in the plurality of air chambers 150 are discharged to the space above the shoe sole 110 simultaneously. Thus, fresh air is introduced to the interior of the shoe.

Third Embodiment

Figure 12:
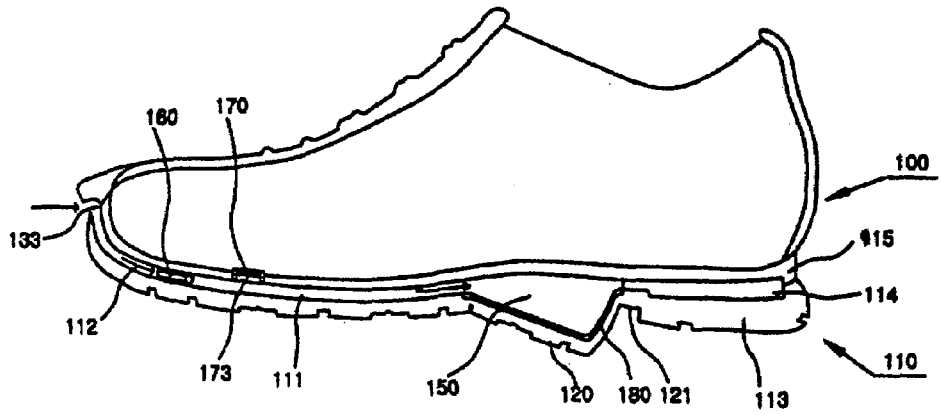
FIG. 12 is a sectional view showing the flow of air in a shoe according to a third embodiment of the present invention when the shoe is separated from the ground.
Figure 13:
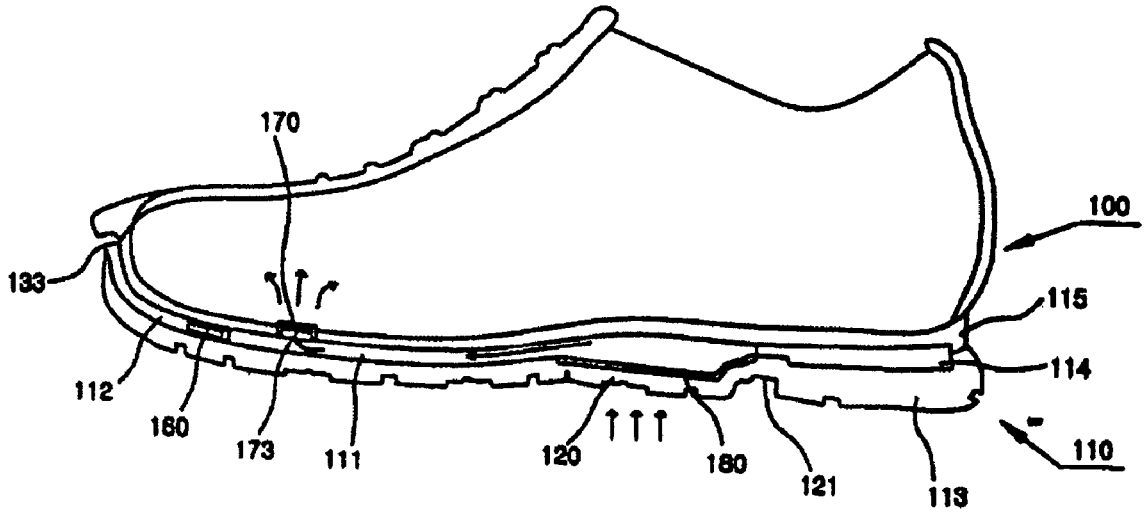
FIG. 13 is a sectional view showing the flow of air in the shoe according to the third embodiment of the present invention when the shoe comes into contact with the ground.
Figure 14:
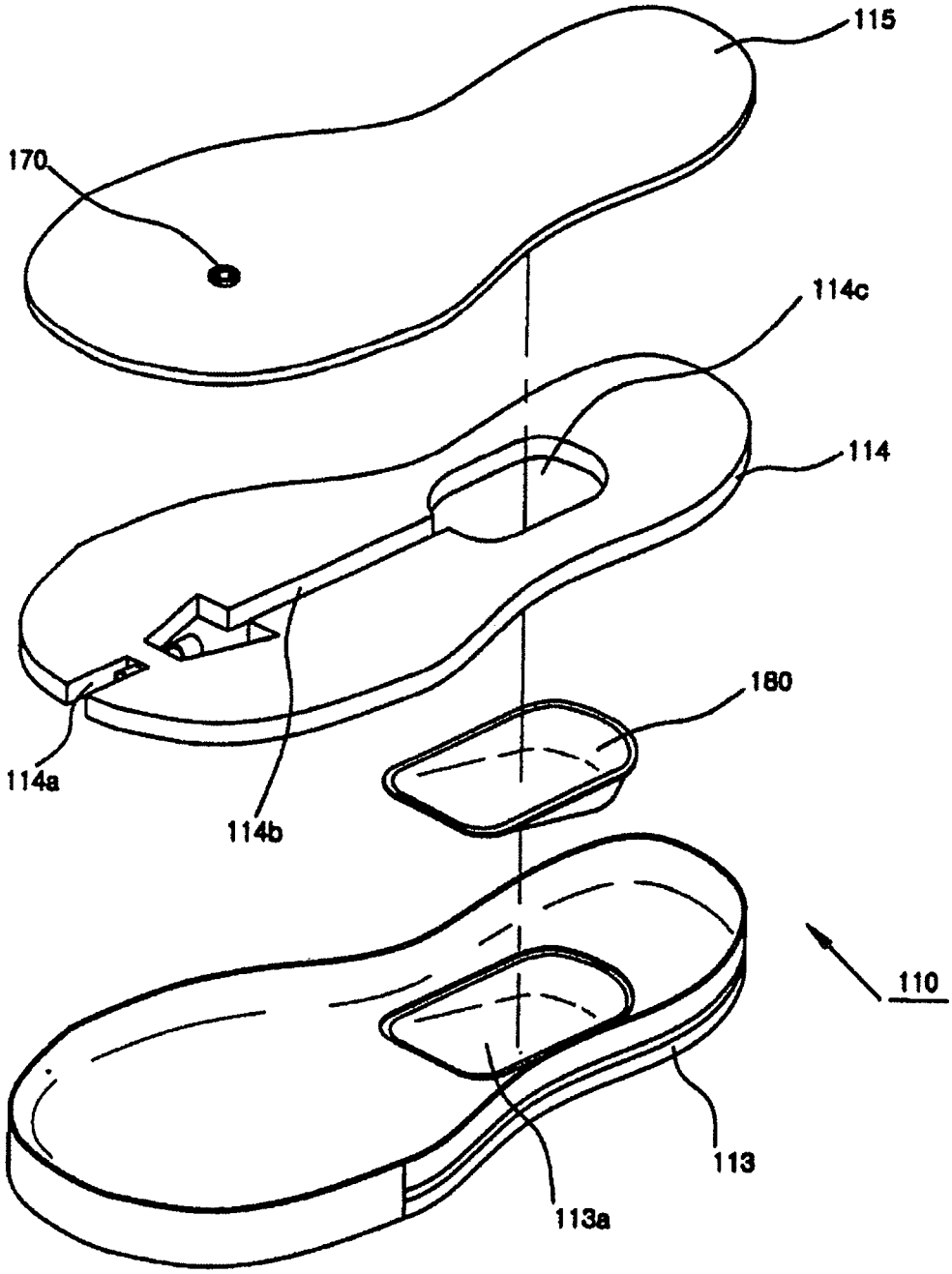
FIG. 14 is a view showing the construction of a shoe sole according to the third embodiment of the present invention.

FIG. 12 is a sectional view showing the flow of air in a shoe according to a third embodiment of the present invention when the shoe is separated from the ground. FIG. 13 is a sectional view showing the flow of air in the shoe when the shoe comes into contact with the ground. FIG. 14 is a view showing the construction of a shoe sole provided in the shoe.

As shown in the drawings, the general shape of the shoe according to the third embodiment remains the same as that described for the second embodiment, except for a provision of an air chamber 150 which is provided in the shoe sole 110 to store air therein while receiving or discharging the air thereinto or therefrom. The air chamber 150 is formed in the shoe sole 110 at a position to correspond to the elastic unit 120 and communicates with the air passage 111. Thus, the air having been stored in the air chamber 150 is discharged from the air chamber 150 through the air passage 111 due to a pressure of the elastic unit 120. Furthermore, both the air passage 111 and the air chamber 150 are sealed on tops thereof. A reinforcing member 180 is provided on a lower portion of the air chamber 150 to protect the air chamber 150 from any materials with pointed tips.

In the third embodiment of the present invention, the upper part 100 of the shoe may be constructed without both the inner part 101 and the through hole 103, so that the entrance 135 to communicate with the through hole 103 may be removed from the air circulation unit 130 of the shoe.

Furthermore, a first check valve 160 is provided in the air channel 112 that communicates with the air passage 111, while a vent hole 173 is provided on the upper surface of the air passage 111 to communicate with the interior of the upper part 100. A second check valve 170 is provided in the vent hole 173 to selectively allow air, which has flowed from the air chamber 150 to the air passage 111, to flow to the interior of the upper part 100.

The first and second check valves 160 and 170 have the same constructions as those described for the second embodiment, and further explanation for the constructions of the check valves is thus not deemed necessary.

The first check valve 160 is installed in the air channel 112 to allow for a normal flowing of air from the air channel 112 to the air chamber 150 but prevent a reverse flowing of air from the air chamber 150 to the air channel 112.

The second check valve 170 is installed in the vent hole 173 that allows for a communication of the air passage 111 with the interior of the upper part 100. Thus, when the elastic unit 120 is compressed, an inner pressure of the air chamber 150 opens the second check valve 170. In the above state, air is introduced from the air chamber 150 to the interior of the upper part 100 through the second check valve 170, so that fresh air is supplied to the foot wearing the shoe.

In the present invention, to allow for easy formation of the air chamber 150, the air passage 111 and the air channel 112, and for easy installation of the first and second check valves 160 and 170, the shoe sole 110 preferably comprises three parts that are separately produced prior to being integrated into a single structure. The construction of the shoe sole 110 will be described in detail herein below.

The shoe sole 110 comprises a lower sole part 113, a middle sole part 114 and an upper sole part 115 which are sequentially laminated and attached on top of another such that the middle sole part 114 and the upper sole part 115 are sequentially layered on the lower sole part 113. In the description of the present invention, the term "sole part" is used only for ease of description. The lower sole part 113 forms an outsole of the shoe, while the middle sole part 114 alone or an integrated body of the middle and upper sole parts 114 and 115 forms a midsole of the shoe.

The lower sole part 113 is a part that comes into direct contact with the ground. Because the lower sole part 113 is provided on the lower surface thereof with the elastic unit 120 that projects downward, the upper surface of the lower sole part 113 is provided with a depression 113*a* that is depressed downward.

The middle sole part 114 is closely layered on the upper surface of the lower sole part 113, with a front slot 114*a* and a rear slot 114*b* formed along a central axis of the middle sole part 114 by cutting a part of the middle sole part 114 from a front end to a rear part of the middle sole part 114. Furthermore, an opening 114*c* is formed on the middle sole part 114 at a position to correspond to the depression 113*a* of the lower sole part 113.

When the lower sole part 113, the middle sole part 114 and the upper sole part 115 are integrated into a single structure, the front slot 114*a* defines the air channel 112. Furthermore, the rear slot 114*b* defines the air passage 111, while both the depression 113*a* of the lower sole part 113 and the opening 14*c* of the middle sole part 114 define the air chamber 150.

A first check valve 160 is installed in the middle sole part 114 at a position between the front and rear slots 114*a* and 114*b*. The first check valve 160 has a shape to connect the front and rear slots 114*a* and 114*b*.

A vent hole 173 is formed vertically through the upper sole part 115 at a position to correspond to the rear slot 114*b* of the middle sole part 114, with a second check valve 170 installed in the vent hole 173. When the shoe sole 110 is constructed with several sole parts as described above, it is easy to form the air passage 111, the air channel 112 and the air chamber 150, and easy to install the first and second check valves 160 and 170 in the shoe sole 110.

When the shoe according to the third-embodiment comes into contact with the ground, the elastic unit 120 of the shoe sole 110 is compressed upward and elastically deformed by a contact pressure applied thereto from the ground, thus being horizontally leveled with the remaining part of the lower surface of the shoe sole 110. Due to the above-mentioned upward compressed state of the elastic unit 120, the air chamber 150 provided on the upper surface of the shoe sole 110 is reduced in the sectional area. Thus, the first check valve 160 prevents the air that has stored in the air chamber 150 from flowing to the air channel 112, while the second check valve 170 allows the air to flow to the interior of the shoe. Thus, fresh air is introduced to the interior of the shoe.

When the shoe is separated from the ground, the elastic unit 120 expands to open the first check valve 160 and close the second check valve 170 by an expansion pressure of the elastic unit 120. Thus, fresh outside air is introduced into the air chamber 150 through the first check valve 160, the air channel 112 and the air passage 111.

In the third embodiment of the present invention, the air passage 111 and the air chamber 150 may comprise a plurality of air passages and a plurality of air chambers, respectively, as described in the second embodiment.

INDUSTRIAL APPLICABILITY

As described above, the present invention provides a ventilating opening which is provided at a front part of a shoe to communicate with the interior of the shoe, thus allowing for a smooth circulation of air into and from the interior of the shoe while a user is wearing the shoes. Therefore, the present invention has a first advantage in that the interior of the shoe is ventilated.

Second, the present invention is advantageous in that the ventilating opening which communicates with the interior of the shoe is opened or closed, so that a user selectively controls the ventilating opening to introduce air to the interior of the shoe as desired.

Third, when the shoe sole according to the present invention comes into contact with the ground while a user is wearing the shoes, the shoe sole functions as a cushion, like an air bag, and a pump, thus forcibly discharging air from the interior of the shoe to the atmosphere. Therefore, the air smoothly flows to and from the interior of the shoe.

Fourth, the present invention continuously introduces fresh air from the atmosphere to the interior of the shoe, in place of circulating air in the interior of the shoe without allowing for the introduction of fresh air into the shoe. Thus, the shoe of the present invention absorbs heat, and thereby reduces the temperature of space in the shoe, and prevents the interior of the shoe from being dampish due to the perspiration of the foot.

Fifth, the inlet air quickly flows to the interior of the shoe through a small-sized air discharge port of a check valve, so that the operational efficiency of the present invention to reduce the temperature of the interior of the shoe is enhanced.

What is claimed is:

1. A shoe comprising:

an upper part having a through hole formed adjacent to a front part of the upper part;

a shoe sole mounted to a lower portion of the upper part, the shoe sole including an air channel at a front part of the shoe sole and an air passage extending from the air channel to a rear part of the shoe sole in fluid communication with the air channel;

an elastic unit formed at a lower area of the shoe sole, at least a portion of the elastic unit defining an inner cavity corresponding to the air passage of the shoe sole, the elastic unit being deformable while reducing its inner cavity when a user wearing the shoe steps on the ground and being restorable while restoring its inner cavity when the user releases the shoe from the ground, the elastic unit having an elastic groove formed upward on a lower surface of the shoe sole along each lateral side of the elastic unit for facilitating said deformation and restoration of the elastic unit; and an air circulation unit disposed at a front part of the shoe sole, the air circulation unit defining an air inlet for passing air there-through, the air inlet being in fluid communication with the through hole of the upper part for ventilating inside of the shoe, the air circulation unit including an air circulation path extending through the air circulation unit, the air circulation path being in fluid communication with the air passage of the shoe sole via the air channel of the shoe sole such that, when the shoe is released from the ground, air is introduced from outside to the restored inner cavity of the elastic unit and air passage via the air circulation unit and also to an interior of the upper part through the through hole of the upper part due to said restoration of the inner cavity of the elastic unit inducing the air introduction for the ventilation of the shoe.

2. The shoe according to claim 1, wherein the upper part is provided at a lower end thereof with an inner part having a vertical path hole, and the through hole of the upper part is in fluid communication with an entrance formed at the air circulation unit for said introduction of air to the interior of the upper part.

3. The shoe according to claim 2, further comprising an ON/OFF control unit for selectively opening and closing the air inlet.

4. The shoe according to claim 3, wherein the ON/OFF control unit comprises:

a connection bracket mounted to the air circulation unit;

a body having a plate shape and mounted to the connection bracket;

a grip provided on an end of the body;

an ON/OFF control plug projecting outward from a front part of the body to be inserted into the air inlet of the air circulation unit; and a locking protrusion projecting outward from a rear part of the body to engage with a locking slot that is provided on an end of the air circulation unit.

5. The shoe according to claim 1, further comprising: an air chamber provided at a front end of the air passage to communicate with both the air passage and the air channel, wherein both the air passage and the air chamber are sealed on tops thereof, with both a first check valve provided in the air channel and a second check valve provided on an upper surface of the air chamber.

6. The shoe according to claim 5, wherein the air passage and the air chamber comprise at least two air passages and at least two air chambers, respectively.

7. The shoe according to claim 1, further comprising: an air chamber provided in the shoe sole at a position to correspond to the elastic unit so that the air chamber communicates with the air passage and stores air therein, wherein both the air passage and the air chamber are sealed on tops thereof, with a first check valve provided in the air channel that communicates with the air passage, a vent hole provided on an upper surface of the air passage to communicate with the interior of the upper part, and a second check valve provided in the vent hole.

8. The shoe according to claim 7, wherein the air chamber is provided on a lower portion thereof with a reinforcing member.

9. The shoe according to claim 7, wherein the air passage and the air chamber comprise at least two air passages and at least two air chambers, respedively.

10. The shoe according to claim 7, wherein the shoe sole comprises a lower sole part, a middle sale part and an upper sole part.

11. The shoe according to claim 1, wherein when the user wearing the shoe steps on the ground, the stored air in the inner cavity of the elastic unit and air passage is pressed and at least partially introduced to the interior of the upper part through a vertical opening defined at a lower portion of an inner part of the shoe and is partially discharged through the through hole of the upper part.

12. The shoe according to claim 1, wherein when the user wearing the shoe steps on the ground, the stored air in the inner cavity of the elastic unit and air passage is pressed and at least partially introduced to the interior of the upper part through a vertical opening defined at an upper portion of the shoe sole and is subsequently discharged through the through hole of the upper part.

13. The shoe according to claim 12, further comprising a first check valve for allowing air flow from the air channel to the air passage while restricting air flow from the air passage to the air channel, and a second check valve for allowing air flow from the inner cavity of the elastic unit and air passage to the interior of the upper part via the vertical opening while restricting air flow from the interior of the upper part to the inner cavity of the elastic unit and air passage.

14. The shoe according to claim 13, wherein the first channel is provided in the air channel and the second check valve is provided in an air chamber disposed between the air channel and the air passage.

15. The shoe according to claim 1, wherein the through hole is formed at the upper part at a location corresponding to toes of the user.

16. The shoe according to claim 1, wherein the elastic unit extends from the front part to the rear part of the shoe sole.

17. The shoe according to claim 1, wherein the elastic unit is disposed between the front part and the rear part of the shoe sole.

* * * * *